US007926555B2

(12) United States Patent
Sanderlin et al.

(10) Patent No.: US 7,926,555 B2
(45) Date of Patent: Apr. 19, 2011

(54) SERIES-PARALLEL CONDENSING SYSTEM

(75) Inventors: Frank David Sanderlin, Littleton, CO (US); Herman Peter Fay, Solano-Beach, CA (US)

(73) Assignee: GEA Power Cooling, Inc., Lakewood, CO (US)

( * ) Notice: Subject to any disclaimer, the term of this patent is extended or adjusted under 35 U.S.C. 154(b) by 582 days.

(21) Appl. No.: 11/821,816

(22) Filed: Jun. 26, 2007

(65) Prior Publication Data

US 2008/0006395 A1 Jan. 10, 2008

Related U.S. Application Data

(60) Provisional application No. 60/816,648, filed on Jun. 27, 2006.

(51) Int. Cl.
*F28B 9/02* (2006.01)
*F28F 27/02* (2006.01)

(52) U.S. Cl. ..... 165/113; 165/103

(58) Field of Classification Search ..... 165/110, 165/111, 112, 113, 103; 60/648, 658, 694, 60/697

See application file for complete search history.

(56) References Cited

U.S. PATENT DOCUMENTS

| | | | | |
|---|---|---|---|---|
| 1,597,415 | A * | 8/1926 | Markley | 60/693 |
| 1,782,986 | A | 11/1930 | Dean | |
| 1,855,390 | A | 4/1932 | Ehrhart | |
| 3,596,888 | A | 8/1971 | Heller et al. | |
| 4,253,517 | A | 3/1981 | Timmerman | |
| 4,296,802 | A * | 10/1981 | Larinoff | 165/110 |
| 4,506,508 | A | 3/1985 | Coers et al. | |
| 4,553,396 | A | 11/1985 | Heizer | |
| 6,029,454 | A | 2/2000 | Kefer et al. | |
| 6,233,941 | B1 | 5/2001 | Youssef | |
| 6,332,494 | B1 | 12/2001 | Bodas et al. | |
| 6,484,503 | B1 | 11/2002 | Raz et al. | |
| 6,588,499 | B1 | 7/2003 | Fahlsing | |
| 2006/0151154 | A1 * | 7/2006 | Szabo | 165/112 |

FOREIGN PATENT DOCUMENTS

GB 2226962 A * 7/1990

OTHER PUBLICATIONS

PCT International Search Report, Jul. 18, 2008.

* cited by examiner

*Primary Examiner* — Tho v Duong
(74) *Attorney, Agent, or Firm* — Holland & Hart LLP

(57) ABSTRACT

A series-parallel condensing system comprised of an air-cooled condenser, a surface condenser, a circulating water system and a cooling tower, body of water, or other equivalent heat sink. The cooling tower, being an evaporative device, consumes water. In the simplest embodiment of the invention steam is condensed in a two-stage series process with steam first fed to an air-cooled condenser where the majority of the steam is condensed and then to a surface condenser, which in conjunction with the circulating water system and cooling tower condenses the remaining steam. This embodiment achieves the greatest degree of water conservation. The function of the surface condenser is to replace the dephlegmator of the air-cooled condenser, which results in a significant reduction in the size and cost of the air-cooled condenser and also yields improved plant performance and operational simplicity. In a second embodiment, where additional makeup water is available, a steam bypass system is added converting the system from a series condensing process into a series-parallel process. In this arrangement steam exiting the turbine flows through both the air-cooled condenser and also through the bypass system with final condensation taking place in the surface condenser.

18 Claims, 6 Drawing Sheets

SERIES-PARALLEL CONDENSING SYSTEM

RELATED APPLICATION

The present application is a non-provisional application which claims priority to U.S. Provisional Patent application Ser. No. 60/816,648, filed Jun. 27, 2006, incorporated herein in its entirety for all purposes.

TECHNICAL FIELD

The present application is related to condensing systems for steam turbines.

BACKGROUND OF THE INVENTION

This invention relates to series-parallel condensing systems used in thermal power stations that employ both air-cooling and evaporative cooling, and more specifically, to a system that is more efficient, less costly and easier to operate than current state of the art parallel condensing systems.

Thermal power stations throughout their history have utilized the Rankine steam cycle to generate electric power. This involves massive rejection of waste heat to the environment. In early designs this was accomplished by first condensing the steam exiting the turbine in a surface condenser and then transporting the heat by means of a circulating water systems to large bodies of water, rivers or cooling towers. Such systems were relatively low in cost and also allowed for efficient plant operation in the warmer parts of the year. Therefore the use of wet evaporative based cooling systems was standard practice for more than half a century until the feasibility of siting ever-larger power plants became problematical with respect to water availability or environmental impact. This led to the gradual introduction of air-cooled condensers, which required no water and had minimal environmental impact, but unfortunately increased the cost of the power plants and also resulted in a loss of electric generation, particularly during the warm periods of the year.

To mitigate the disadvantages associated with all dry air-cooled condensing and the water and environmental problems associated with wet evaporative cooling, parallel condensing systems were introduced in the early 1990's. Such systems employ an air-cooled condenser and a surface condenser that are connected via parallel steam paths to the plant's turbine's exhaust. The surface condenser in turn is connected in a conventional manner via a circulating water system to a cooling tower, body of water, or other water based heat sink.

Such parallel condensing systems could readily be designed to vary the fraction of heat rejected by the wet and dry sections of the system depending on water availability or environmental constraints. Furthermore, since water availability was generally based on annual limitations, the water consumption profile could be shaped to maximize use of the wet evaporative section in the warm part of the year to make up for the loss in performance in the air-cooled condenser during these conditions. In typical parallel condensing system applications the cost of the air-cooled condenser was cut dramatically, annual water consumption was reduced by two thirds or more and plant output during warm weather was nearly the same as for all-wet evaporative cooling. In addition, water related environmental impacts were highly reduced resulting in greater plant siting flexibility and faster plant permitting cycles.

The air-cooled condensers employed in parallel condensing systems of the type described above utilized a two stage series condensing process commonly referred to as a K-D condensing process. A brief description of this process follows.

The two-stage K-D condensing process was devised in order to eliminate so called "dead zones" in air-cooled condensers in which no condensation takes place. In the K-D process steam first enters the K section heat exchangers from above and in which steam and forming condensate flow in the same direction. By limiting the length of the K tubes and by properly modulating airflow, condensation is not allowed to complete in this section and some steam exits all fin tube rows at the bottom under all operating conditions along with draining condensate.

Steam leaving the K section is collected in a header that transports the steam into the second stage, commonly referred to as a dephlegmator or D stage, where steam enters the heat exchangers from below. Steam and forming condensate flow in counterflow direction to each other in this section. The size of the D section can vary between as little as 1/10 to 1/3 or more of the overall deployed condenser heat transfer surface depending on climatic and plant loading conditions. Condensation finally completes near the very top of the D section with the remaining upper interior tube volume being filled with non-condensibles, principally air. Non-condensibles are continuously removed by ejection equipment. During sub-freezing atmospheric conditions the remaining moisture contained in the non-condensibles freezes on the cold tube walls in the form of a soft rime ice and slowly closes the tube passages. Without any further active measures being taken this would result in a cessation of air removal from the dephlegmator tubes, followed by air filling the entire D section, followed by intrusion of air into the K section. The condenser would now be subject to serious freeze damage and performance degradation. In order to prevent the above noted freezing problems from occurring it is necessary engage in a continuous active dephlegmator warming program. This consists of periodically reducing the speed of the fans serving D sections. This results in steam flooding of the upper end of the D tubes, which melts the rime ice. This procedure, although generally solving the problem of freeze damage to the condenser, results in significant control system complications and also very demanding operator attention during cold weather periods. In addition the frequent airflow modulation required in the D sections causes fluctuations in turbine back-pressure that affect plant output and reliability.

The condensate formed in both the K and D sections initially drains into the common bottom header connecting these sections. This condensate is somewhat sub-cooled due to contact with cold tube surfaces. The condensate is collected in the header and then routed to the condensate tank in a system of drainpipes that are normally heat traced and insulated to prevent condensate freeze-up during cold weather. Even though the drainpipes are heat-traced and insulated, additional sub-cooling of condensate still occurs in the drain lines. Sub-cooling of condensate is deleterious because it decreases thermodynamic efficiency and, more importantly, increases the dissolved oxygen content of the condensate. Dissolved oxygen in the condensate creates serious corrosion problems in the overall steam cycle. Therefore separate condensate deaerators are frequently required and incorporated in the drain systems of K-D condensing systems to control the amount of sub-cooling, adding complexity and cost.

Although the K-D system satisfies the crucial requirement of minimizing unwanted "dead zones" in the condenser and providing reliable operation in extreme cold weather, inherently high internal steam side pressure drops degrade its performance. These result from the fact that the steam must pass in series through two stages of fin tubes plus a steam transfer header, producing considerable friction losses plus additional turning and acceleration losses leaving and entering the two sets of fin tubes. These parasitic pressure losses produce a corresponding drop in the saturation temperature of the steam, which reduces the temperature difference potential between steam and cooling air, and thus the efficiency of the air-cooled condensing system.

In addition to the complications already noted several additional features must typically be incorporated in K-D systems for proper and safe operation. These include a condensate collection tank to collect the condensate draining from the transfer headers, a pressure equalizing line between turbine exit and the condensate tank and draining facilities to continuously remove condensate from of the main steam duct to the condensate tank.

SUMMARY OF THE INVENTION

It is an object of the present invention to provide a new and improved condensing system which employs a series-parallel condensing process and which is simpler, more efficient, less costly and easier to operate than current state of the art parallel condensing systems.

According to one aspect of the present invention, a condensing system is provided which condenses steam in two stages arranged in series. In the first stage steam is condensed by means of air-cooling in heat exchangers arranged as a K section. Steam enters these heat exchangers from above flowing downward along with forming condensate. Steam and condensate leaving the first stage are collected in a header connected to the exit side of the first stage heat exchangers. The combined flow is then routed via steam ducting to a conventional surface condenser comprising the second condensing stage where condensation is completed. The need for a second stage air-cooled D section is therefore eliminated.

The second stage surface condenser is connected to a wet evaporative heat sink by means of a circulating water system. The heat sink is generally a mechanical draft cooling tower but may also be a body of water such as a lake or river. Generally the second stage surface condenser is sized to have a capacity that is about ⅙ that of the steam entering the first air-cooled stage. In this arrangement the collapsing steam in the second stage acts as a powerful suction device that draws both steam and non-condensibles out of the first stage and assures that all non-condensibles are effectively removed from the first stage under all operating conditions, particularly during extremely cold weather. All condensate is collected in the hotwell of the surface condenser and the non-condensibles are removed from the surface condenser by conventional ejection equipment thus completing the condensing function of the steam cycle. The series condensing process described is highly water conserving in that it requires only approximately ⅙ the water of all wet evaporative based condensing systems while in addition reducing the size of the costly air-cooled condenser by at least the same amount.

In a second embodiment of the invention used if more water is available the two stage series condensing arrangement is modified by adding a direct inter-connection between the main steam duct and the inlet of the surface condenser and by correspondingly enlarging the capacity of the surface condenser, circulating water system and cooling tower. This allows simultaneous series and parallel feed capability to the surface condenser further reducing the size of the costly air-cooled first stage.

In order to maintain the required exit flow fraction out of the first air-cooled condensing stage at all times in the series-parallel arrangement, generally in the range of ⅙ of incoming flow, it is necessary to appropriately throttle the second (parallel) steam path to the surface condenser. This is accomplished by incorporating a throttling valve in the parallel feed line. The valve position is adjusted so that the pressure drop across the first stage condenser, which is also a measure of flow, is always in the same relationship to the pressure drop between the exit of the first stage and surface condenser inlet. If we refer to the pressure drop across the first stage as DP1 and the pressure drop between the exit of the first stage and the surface condenser inlet as DP2 the throttling valve will be adjusted so that during operation DP2/DP1 is always equal to or greater than a prescribed constant. This relationship is unaffected by changes in steam operating pressure. The throttling valve allows an operator, at his discretion, to periodically override the control system and further throttle steam flow in the parallel feed line and thereby increase the steam flow exiting the air-cooled first stage if there is any indication that non-condensibles are present. This would be indicated by low reading temperature sensors placed in the exit headers of the first stage. As a further safety measure the throttling valve incorporates a stop so that it can never be fully opened. This induces a minimum level of pressure drop in the parallel feed line during operation that is sufficient to maintain required exit flow from the air-cooled first stage.

BRIEF DESCRIPTION OF THE DRAWINGS

The invention will be better understood from the following detailed description of some exemplary embodiments of the invention, taken in conjunction with the accompanying drawings, in which like reference numerals refer to like parts, and in which.

DETAILED DESCRIPTION OF THE DRAWINGS

Figure 1:
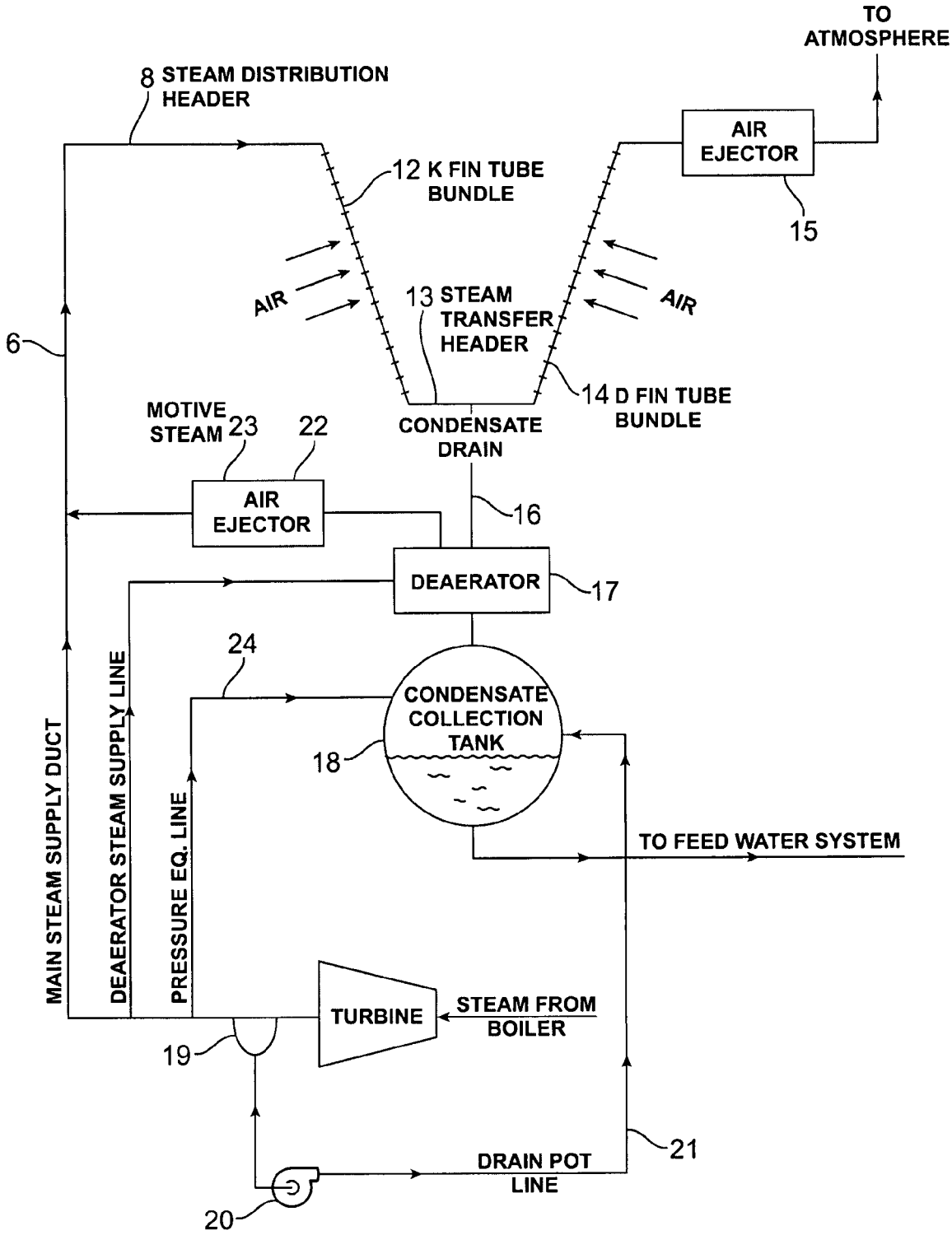
FIG. 1 (PRIOR ART)
FIG. 1 is a schematic illustration of a typical two-stage K-D type air-cooled condenser

FIG. 1 is a schematic illustration of a typical K-D type single pressure, two-stage air-cooled condensing system that constitutes the portion of a prior art parallel condensing system that is air-cooled. In such an air-cooled condenser the main steam supply duct 6 transports steam from the turbine to a steam distribution header 8 and from there to the top of each K-section fin tube bundle 12. Most of the steam is condensed as it travels down each K fin tube. The remaining steam leaving the K bundles is collected in the steam transfer header 13 and routed to the D fin tube bundles 14, entering the bundles from the bottom.

The D-section, in the process of condensing steam, develops a powerful suction, which draws steam out of the K-section. This also sweeps any non-condensibles present in the K-section into the D-section where they are removed by ejection equipment 15. The D section is also highly tolerant to the presence of non-condensibles that collect in its upper region during freezing conditions, whereas the presence of non-condensibles, forming so-called "dead zones" in the K section, would normally lead to ice formation and damage to the tubes. The D section therefore serves an essential and necessary function in the condensing process.

Condensate draining from the K and D sections is collected in the steam transfer header 13 and is routed via drain pipes 16 to a deaerator 17, and from there to a separate condensate collection tank 18. The deaerator requires a separate air ejector 22 with its own motive steam supply 23. A drain pot 19 collects condensate forming in the main steam supply duct which is pumped by a transfer pump 20 via drain pot line 21 back to the condensate collection tank. A pressure equalizing line 24 is provided between the turbine exhaust line and the condensate tank, so that the vapor space in the condensate tank is essentially at the same pressure and temperature as in the main steam duct 6.

The steam path from the turbine to the point where condensation is complete is long and torturous in typical K-D type condensing systems. Steam being condensed in the sizeable D section must first pass through the K section. This increases steam velocities in the K section significantly with attendant added pressure losses and reduction in the available log mean differential temperature (LMDT) between cooling air and steam. The incoming steam typically undergoes four ninety-degree turns in its path from the turbine to the upper steam distribution header 8. It must also make additional turns and flow through a long steam transfer header 13 before reaching the D section 14. This adds considerable pressure drop, reducing the efficiency of the heat exchange process. The steam pressure drop between the steam transfer header 13 and the air ejector 15 is also relatively high because the steam must pass through the D section and then through long lines incorporating numerous turns to the ejector. The reduced suction pressure at the ejector significantly decreases its capacity, which lowers the efficiency of the overall condensing system, particularly when operating at low turbine backpressures.

Figure 2A:
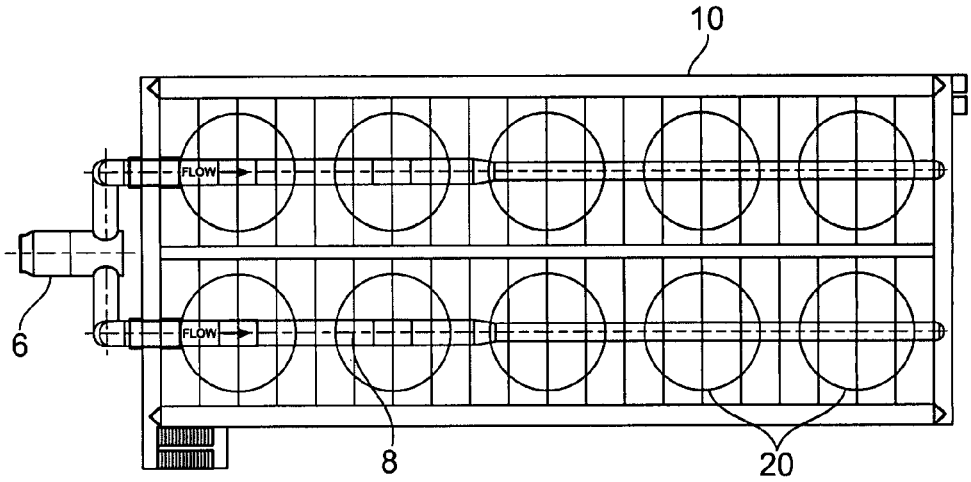
FIG. 2A (PRIOR ART)
FIG. 2A is a top plan view of a physical arrangement of a typical prior art two-stage K-D type air-cooled condenser used in parallel condensing systems.
Figure 2B:
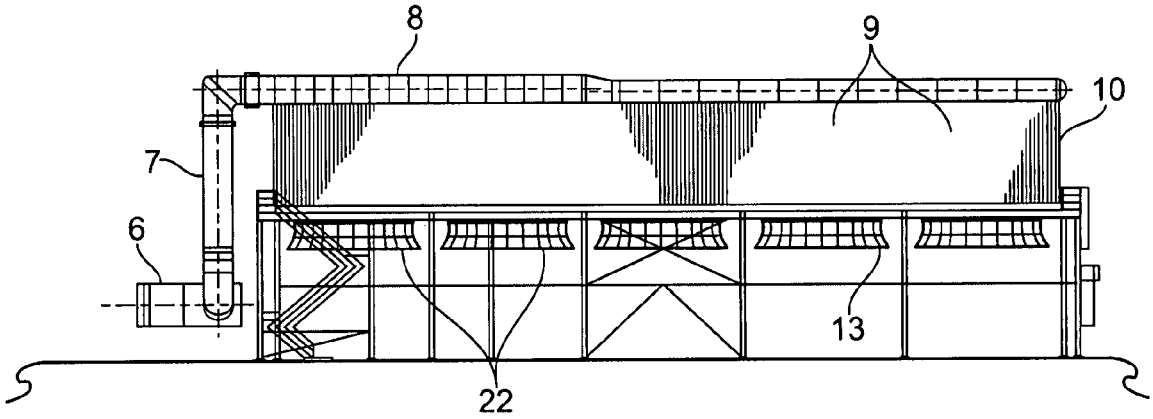
FIG. 2B (PRIOR ART)
FIG. 2B is a side elevation view corresponding to FIG. 2A.

FIGS. 2A and 2B illustrate the physical arrangement of an air-cooled K-D type condenser. Usually, a plurality of multiple fin bundle cells 9 are arranged adjacent to one another in roof sections forming an air-cooled condenser installation 10. FIGS. 2A and 2B illustrate a two roof section, ten cell arrangement, with the roof sections being acted upon in parallel by exhaust steam fed in from a main steam duct 6, connecting riser ducts 7, and upper steam distribution headers 8 for each condenser roof section. Each distribution header 8 feeds four K cells located on the outboard sides of the roof sections from the top. Steam leaving the K cells at the bottom is transported via transfer header 13 to the two center cells in installation 10 which are dephlegmator or D cells. In the standard forced draft arrangement of FIGS. 2A and 2B, each condenser roof section is an A-frame having series connected K-D stages, with multiple fans 20 below each condenser section which draw air in through inlet bells 22 below each condenser cell.

Figure 3:
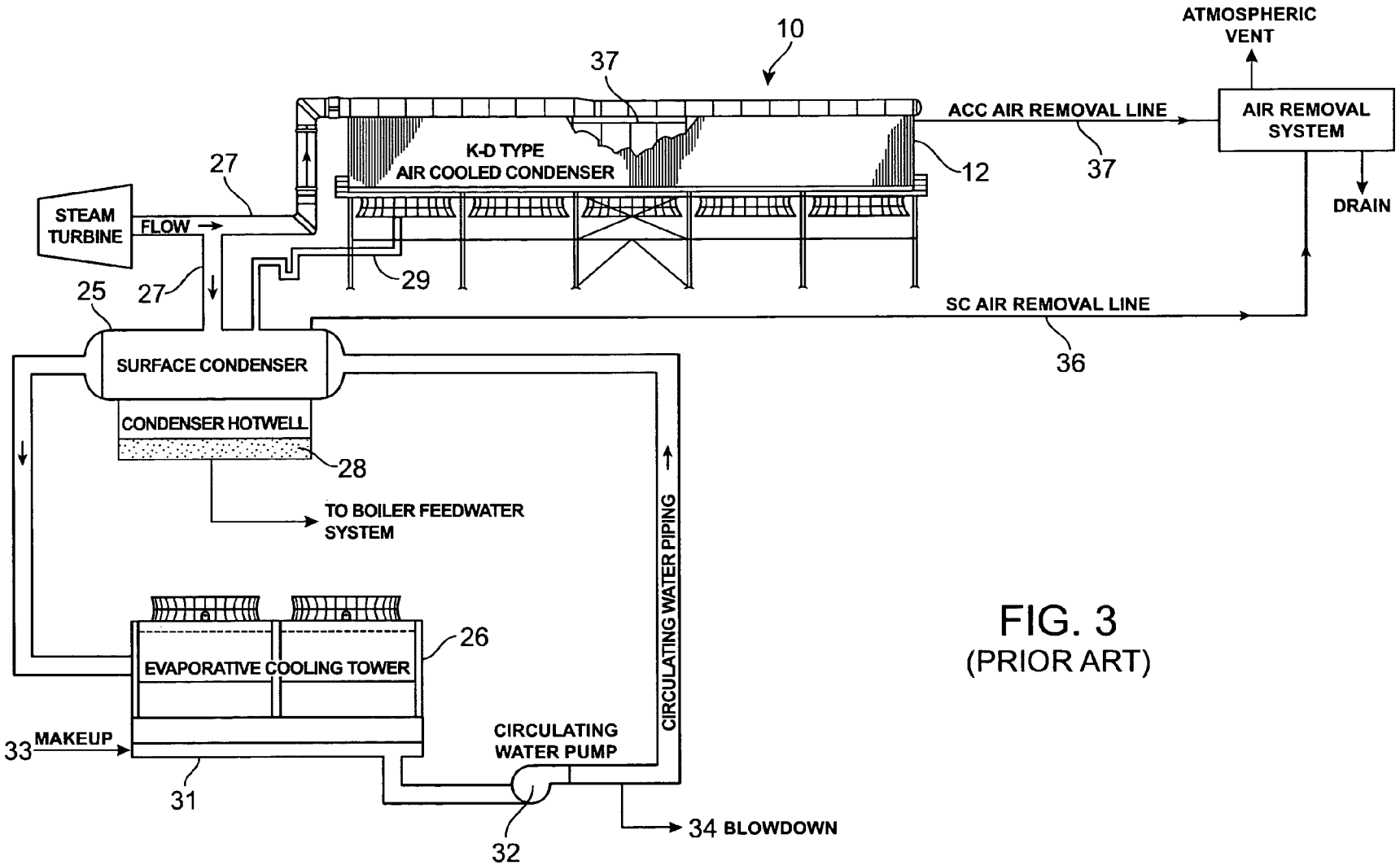
FIG. 3 (PRIOR ART)
FIG. 3 is a schematic illustration of a typical prior art parallel condensing system utilizing a two-stage K-D type air-cooled condensing system.

FIG. 3 is a schematic illustration of a typical prior art parallel condensing system. The main elements of the system are a K-D type air-cooled condenser 10, a surface condenser 25 and a mechanical draft cooling tower 26. Steam condensation is accomplished by first transporting steam through parallel steam ducting 27 from the turbine to the air-cooled condenser 12 and the surface condenser 25. The steam is then condensed in both the surface condenser and the air-cooled condenser. Condensate forming in both devices is collected in a common hotwell 28 incorporated in the surface condenser and is returned from there to the feedwater system. Condensate formed in the air-cooled condenser is transported to the inlet side of the surface condenser via drain lines 29 incorporating a loop seal. The somewhat sub-cooled condensate entering the surface condenser is reheated in passage through the tube field of the surface condenser thus precluding the need for a deaerator.

The surface condenser 25 is connected via circulating water piping 30 to the mechanical draft cooling tower 26. Cold water is drawn from the cooling tower basin 31 by a pump 32 and then circulated to the surface condenser where it leaves heated. The hot water is returned to the cooling tower where it is re-cooled. In the process water is evaporated in the cooling tower, which is replenished by a make-up system 33. In order to limit the cycles of concentration in the circulation water system due to evaporation a continuous small stream of circulating water is discharged in a blowdown system 34. The amount of heat rejection desired in the surface condenser which is proportional to water consumption is regulated by adjusting the speed of the cooling tower fans. If no heat rejection is required by the surface condenser, as can be the case during cold weather, both the fans and the circulating water pump 32 are turned off. The K-D type air-cooled condenser operates in conventional fashion as previously described. Generally the air-cooled condenser is operated at maximum capacity with all fans operating at full speed. If however it is necessary to reduce its capacity this is accomplished by reducing the speed of the fans. The system therefore offers wide flexibility in proportioning the amount of heat rejected to the environment by air-cooling and by evaporation. Generally this includes the capability to operate all-dry during the coldest period of the year. The fact that this is accomplished by an air-cooled condenser that is significantly smaller than an all-dry system is advantageous with respect to freeze-protection.

Noncondensibles, principally air, must be continuously ejected from both the surface condenser 25 and the air-cooled condenser 12 in order to preclude the formation of "dead zones". This is accomplished by conventional air ejection equipment 35 that suctions off the non-condensibles through air removal lines 36 and 37.

Figure 4:
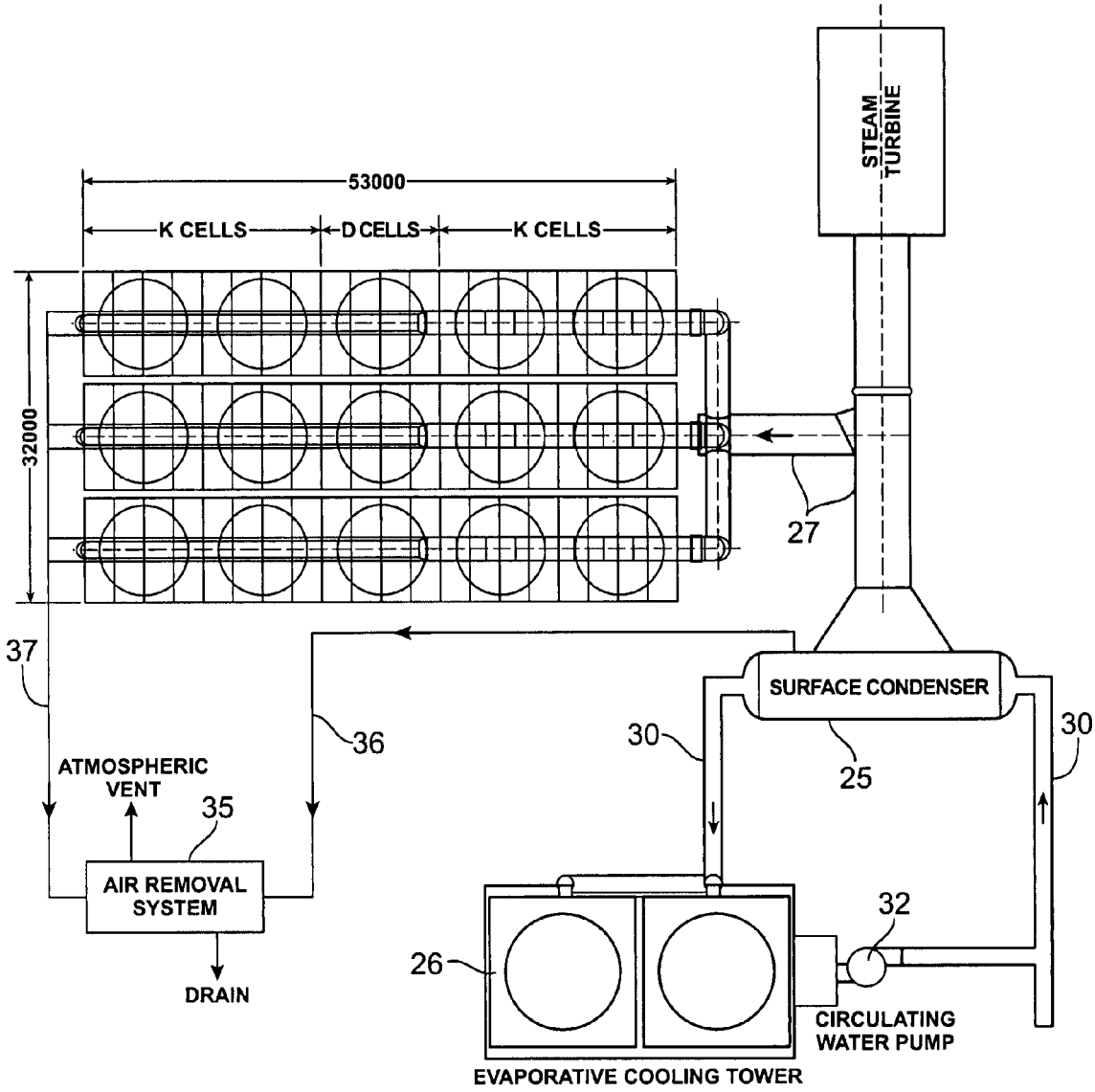
FIG. 4 (PRIOR ART)
FIG. 4 is a top plan view of the prior art parallel condensing system of FIG. 3.

The physical arrangement of a typical prior art parallel condensing system is shown in simplified form in plan view FIG. 4. As can be seen the D cells are a significant portion of the air-cooled condenser installation, comprising 20% of its overall size. As is also evident the required non-condensible suction line network 37 connected to the air-cooled condenser is extensive and very long.

Figure 5:
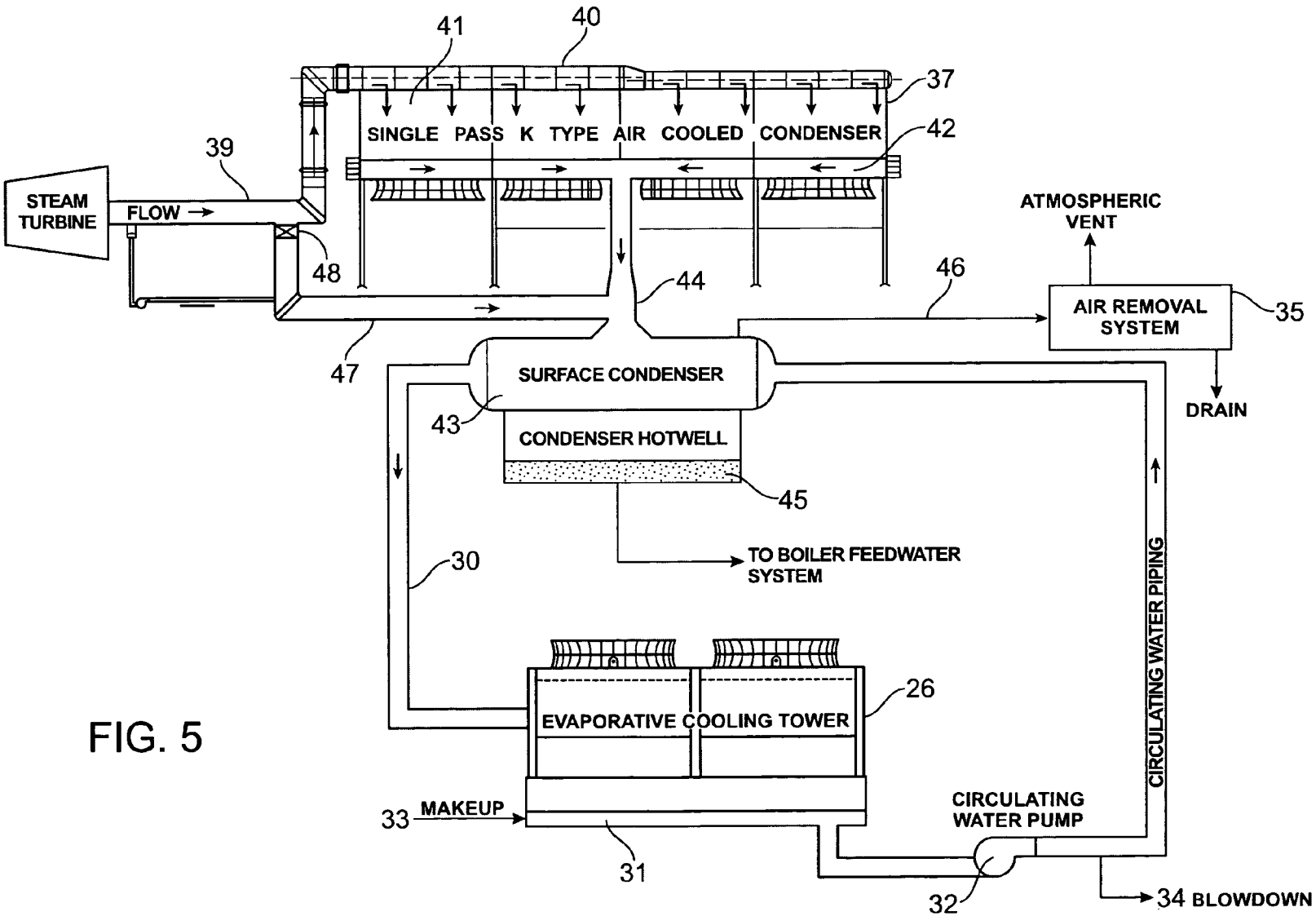
FIG. 5 is a simplified schematic of a two-stage series-parallel condensing system according to an exemplary embodiment of the present invention.

FIG. 5 is a schematic representation of the condensing process of the present invention wherein the D cells used in prior art air-cooled condensers are eliminated and replaced by a surface condenser. The surface condenser performs the same function of suctioning steam and non-condensibles out of the K section as the D section it replaces. In this arrangement steam is transported from the turbine to the air-cooled condenser 37 in a main steam duct 39 where it enters distribution ducts 40 that feed the K sections heat exchangers 41 from the top. A header 42 connected to the bottom of the K section heat exchangers collects steam and condensate from the K section, which is then transported to the surface condenser 43 in steam duct 44. The steam and condensate enter the surface condenser at the top. The remaining steam is condensed in the surface condenser and all condensate is collected underneath the surface condenser in an integral hotwell 45. From there the condensate is returned to the feedwater system. The surface condenser is connected to a circulating water system 30 and cooling tower 26 in the same manner as previously described. A short air removal line 46 interconnects the surface condenser and the air ejection equipment 35. The surface condenser capacity is set to condense as a minimum an amount of steam that is equivalent to the air-cooled condenser D section that it replaces. Typically this is in the range of ⅙ of the steam entering the air-cooled condenser but can be greater or lesser depending on site climatic conditions and steam plant load turndown requirements specific to the application. This assures that non-condensibles are completely swept out of the air-cooled condenser along with the steam into the surface condenser under all operating conditions. The selected surface condenser capacity also establishes the minimum year-round makeup water requirement of the wet evaporative heat rejection system. When operated in this manner the system operates as a two-stage series flow condensing process.

If more make-up water is available the size of the surface condenser, associated circulating water system and cooling tower is proportionally increased and the size of the air-cooled condenser is proportionally decreased. A steam duct 47 interconnecting the main steam duct and surface condenser is added to the system so that steam can be bypassed around the air-cooled condenser directly into the surface condenser creating a series-parallel condensing process. This reduces the amount of steam that must pass through the air-cooled condenser to a practical minimum, eliminating unnecessary parasitic pressure losses that would otherwise occur. When operating in the series-parallel condensing mode the quantity of steam flowing into the air-cooled condenser must be of sufficient magnitude so that the required minimum exit flow is maintained to assure that non-condensibles are swept out of the air-cooled condenser and into the surface condenser. A throttling valve 48 is incorporated in the steam duct 47, which through proper regulation induces enough resistance to maintain the above noted flow proportions at varying plant loads and ambient temperature conditions. Water consumption is regulated by modulating cooling tower fan speed and the amount of air-cooled condensation is regulated by modulating air-cooled condenser fan speed.

The above noted inlet/exit flow proportioning required for proper and safe air-cooled condenser operation is maintained by a control system. Regulation input is derived from measurements of the pressure drops across the air-cooled condenser (DP1) and between the exit of the air-cooled condenser and surface condenser inlet (DP2) using sensing instruments. By maintaining the relationship of these pressure drops constant through modulation of the throttling valve 48, flow proportioning of the desired magnitude is maintained by the control system irrespective of condenser operating pressure. As a safety measure the throttling valve 48 normally incorporates an integral stop, which precludes the valve from being fully opened so that a designated minimum amount of flow resistance always exists in bypass duct 47. This assures that the required above noted flow proportion is not exceeded and that a sufficient quantity of steam always exits the air-cooled condenser.

Figure 6A:
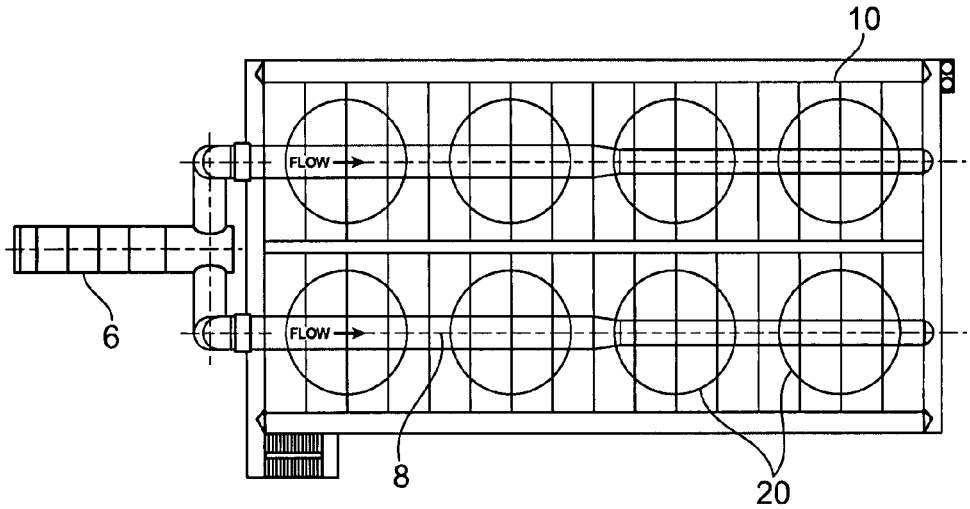
FIG. 6A is a plan view of the first stage of a two-stage series condensing system according to a second embodiment of the present invention.
Figure 6B:
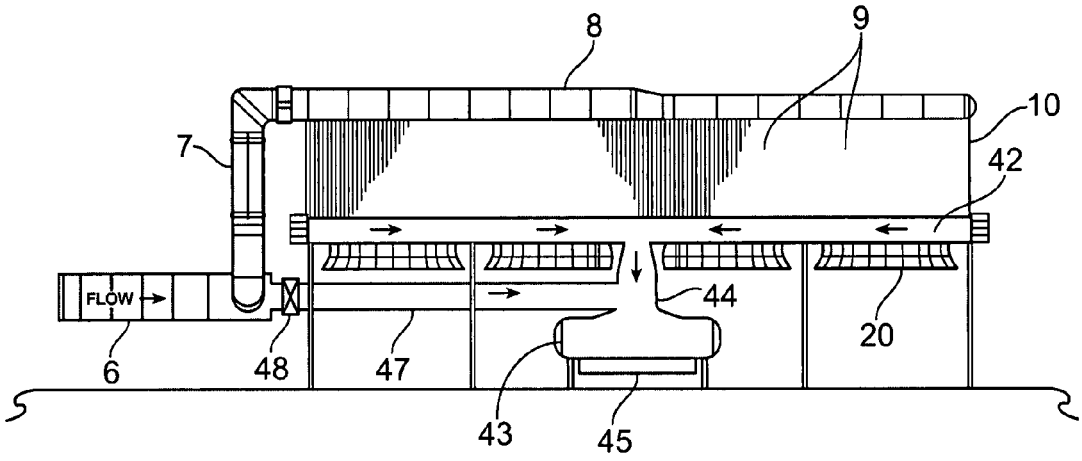
FIG. 6B is a side elevation view illustrating the physical arrangement of the air-cooled condenser and surface condenser of FIG. 5.

The physical arrangement of the air-cooled condenser 10 and surface condenser 43 employed in the series-parallel condensing system is shown in FIGS. 6A and 6B. As can be seen, the D cells employed in the air-cooled condensers of prior art parallel condensing systems are eliminated resulting in approximately ⅙ of the cells being eliminated. The surface condenser 43 is typically located underneath the roof sections in the center of the air-cooled condenser. All steam exiting the K cells is collected in headers 42 and transported via steam duct 44 to the surface condenser inlet. Similarly, bypass steam is transported in duct 47 incorporating throttle valve 48 from the main steam duct 6 to the inlet of surface condenser 43.

The series-parallel condensing system of the present invention offers numerous advantages over prior art parallel condensing systems as enumerated below.

The air-cooled condenser is smaller simpler and less costly by virtue of the fact that the air-cooled dephlegmator sections are eliminated.

The surface condenser provides reliable and robust suctioning of all non-condensibles out of the air-cooled condenser at all times, particularly during sub-freezing ambient conditions. The need to engage in dephlegmator warming cycles, which can cause unstable air-cooled condenser operation, is avoided. Nevertheless, if presence of non-condensibles in the air-cooled condenser becomes evident it is possible to readily eject them by either reducing airflow it the air-cooled condenser or increasing airflow in the cooling tower. Another option is to further close the throttling valve 48 in the bypass line, which increases the amount of steam flowing into and out of the air-cooled condenser. In most cases the above described procedures are only required on a temporary basis.

System control is simpler and more stable than in prior art systems since only incremental changes in air flow through either the air-cooled condenser or cooling tower are required in addition to periodic incremental adjustments of the throttle valve position. Also the need for engaging periodic dephlegmator warming cycles is eliminated.

The danger of engaging slug flow conditions in the dephlegmator section of the air-cooled condenser due to high steam inlet velocities flowing in the opposite direction to draining condensate at low turbine backpressures is eliminated. This results in stable operation and improved freeze protection.

The length of the steam flow path through the air-cooled condenser is half that of prior art, reducing associated steam side pressure drops. This results in achievement of year-round higher log mean temperature differentials between cooling air and the steam, which increases the thermodynamic efficiency of the condenser. The steam-side pressure drop in the surface condenser is much lower than the D section it replaces. Therefore turbine backpressures are reduced and the overall thermodynamic efficiency is higher than the prior art.

The reduced steam side pressure losses in the combined air-cooled condenser and surface condenser system compared to prior art coupled with a short and direct air removal line increases the suction pressure of the air ejection equipment, greatly increasing its capacity.

During sub-freezing ambient conditions the series-parallel condensing system can be operated at condenser turbine backpressures lower than 2" HgA, a limit generally imposed on prior art systems by ejection system capacity limitations or freeze damage potential to the air-cooled condenser. This allows the power plant to be operated at peak efficiency during low ambient temperature conditions, which is not possible with prior art systems.

In prior art air-cooled condensers each roof section is arranged in a certain fixed ratio of K cells to D cells. This constraint is removed allowing more cells to be installed in each roof sections. This increased layout flexibility in conjunction with a physically smaller air-cooled condenser due to the absence of the D sections greatly facilitates the placement of the condenser within the allocated plot plan area.

Because of the steam path through the air-cooled condenser is approximately half as long and because the danger of "dead zones" is no longer a factor as in the case of prior art it is feasible to efficiently utilize longer fin tubes. This permits the installation of fewer and larger cells, which reduces costs due to economy of scale.

The need for condensate drain lines is eliminated because the condensate exits the K sections of the air-cooled condenser and drains into the surface condenser along with exhausting steam in common ducting.

Condensate remains in constant contact with steam as it drains into the surface condenser. Next it drains through the tube field of the surface condenser into the hotwell continuing to maintain contact with steam. This long and turbulent contact with steam virtually eliminates any sub-cooling that is initially present and obviates the need for an expensive deaerator required in the prior art.

The series-parallel condensing system minimizes the amount of steam that must flow through the air-cooled condenser at any time. This amount is equal to the steam condensed in the air-cooled condenser plus the additional quantity condensed in the surface condenser associated with satisfying the dephlegmator function. Any additional steam to be condensed in the surface condenser associated with wet evaporative heat rejection is bypassed directly from the main steam duct to the surface condenser. This minimizes the size of the steam ducting and also minimizes steam side pressure losses through the air-cooled condenser.

The series-parallel system can be arranged to be plume free if necessary. This can be achieved by placing the mechanical draft cooling tower in the air inlet section of the air-cooled condenser. The plume leaving the cooling tower is then reheated in passage over the fin tubes of the air-cooled condenser reducing the relative humidity of the exiting air well below 100%. Mixing of the warm air leaving the cooling tower with the remaining air entering the air-cooled condenser has only minor negative effects on the performance of the air-cooled condenser since the airflow through the air-cooled condenser is in the range of ten times greater than through the cooling tower. Placement of the cooling tower in the air inlet section also reduces required plot plan area.

The series-parallel system requires consumptive water use at all times to satisfy the dephlegmator function performed by the surface condenser. This, however still results in a system that is highly water conserving, requiring only approximately ⅙ the water of an all-wet evaporative heat rejection system.

What is claimed is:

1. A series-parallel condenser comprising:

an air-cooled condenser including a steam inlet and a steam outlet;

a surface condenser including a steam inlet and water circulation inlet and outlet ports; and a steam duct system comprising a main steam duct, a first duct connecting the main steam duct to the air-cooled condenser steam inlet, a second duct connecting the main steam duct to the surface condenser steam inlet, and a third duct connecting the air-cooled condenser steam outlet to the surface condenser steam inlet.

2. The series-parallel condenser of claim 1, wherein the air-cooled condenser has only one condensing stage adapted so steam and condensate flow in a concurrent direction.

3. The series-parallel condenser of claim 1, further comprising:

a circulating water system connected to the surface condenser ports; and a heat sink connected to the circulating water system.

4. The series-parallel condenser of claim 3, wherein the heat sink is a cooling tower.

5. The series-parallel condenser of claim 3, wherein the heat sink is a body of water.

6. The series-parallel condenser of claim 1, further comprising a throttle valve in the second duct of the steam duct system.

7. The series-parallel condenser of claim 6, wherein the throttling valve comprises an integral stop that prevents the throttling valve from completely opening, thus ensuring that a minimum amount of flow resistance is present in the second duct.

8. The series-parallel condenser of claim 1, further comprising steam collecting headers positioned in the third duct between the air-cooled condenser and the surface condenser.

9. The series-parallel condenser of claim 1, wherein condensate drains through the third duct into the surface condenser together with exhaust from the air-cooled condenser.

10. The series-parallel condenser of claim 1, wherein the surface condenser steam inlet is located on top of the surface condenser.

11. The series-parallel condenser of claim 1, wherein the surface condenser condenses a portion of total steam that is at least equal to a portion of total steam that would be condensed in a second stage of a two-stage air-cooled condenser.

12. The series-parallel condenser of claim 11, wherein the portion of total steam is about ⅙ of total steam entering the air-cooled condenser.

13. The series-parallel condenser of claim 1, wherein all air formed in the process is swept out of the air-cooled condenser by an exiting steam and finally ejected from the surface condenser.

14. The series-parallel condenser of claim 6, wherein the throttling valve is configured such that a pressure drop across the air-cooled condenser is in the same relationship to a pressure drop between the air-cooled condenser steam outlet and the surface condenser steam inlet.

15. The series-parallel condenser of claim 14, wherein the pressure drop between the air-cooled condenser steam outlet and the surface condenser steam inlet divided by the pressure drop across the air-cooled condenser is equal to or greater than a prescribed constant.

16. A series-parallel condenser comprising:

an air-cooled condenser including a gas inlet and outlet and an ambient air inlet and outlet;

a surface condenser including a gas inlet and outlet and a liquid circulation inlet and outlet; and a duct system comprising a main duct connecting a boiler to the air-cooled condenser gas inlet and the surface condenser gas inlet and a header connecting the air-cooled condenser gas outlet to the surface condenser gas inlet.

17. The series-parallel condenser of claim 16, wherein the air-cooled condenser has only one condensing stage adapted so steam and condensate flow in a concurrent direction.

18. The series-parallel condenser of claim 16, wherein the header is adapted to allow gas and condensate to flow from the air-cooled condenser gas outlet to the surface condenser gas inlet.

* * * * *